United States Patent [19]

Fedder et al.

[11] Patent Number: 4,498,722

[45] Date of Patent: Feb. 12, 1985

[54] LATCH DEVICE FOR ZIF CARD EDGE CONNECTORS

[75] Inventors: James L. Fedder; Michael A. Kandros, both of Harrisburg, Pa.

[73] Assignee: AMP Incorporated, Harrisburg, Pa.

[21] Appl. No.: 557,977

[22] Filed: Dec. 5, 1983

[51] Int. Cl.[3] ..... H01R 13/631

[52] U.S. Cl. ..... 339/75 MP; 339/176 MP

[58] Field of Search ..... 339/75 MP, 91 R, 176 MP

[56] References Cited

U.S. PATENT DOCUMENTS

| | | | |
|---|---|---|---|
| 2,825,037 | 2/1958 | French | 339/75 MP |
| 3,216,580 | 11/1965 | Fricker, Jr. | 339/75 MP |
| 3,932,016 | 1/1976 | Ammenheuser | 339/75 MP |
| 3,982,807 | 9/1976 | Anhalt et al. | 339/75 MP |
| 4,017,138 | 4/1977 | Evans | 339/75 MP |
| 4,196,955 | 4/1980 | Anhalt | 339/75 MP |
| 4,403,819 | 9/1983 | Weber | 339/75 MP |

*Primary Examiner*—John McQuade

*Attorney, Agent, or Firm*—Allan B. Osborne

[57] ABSTRACT

The present invention relates to latching devices for removably retaining circuit cards in zero insertion force card edge connectors. More particularly the invention includes a pair of pivoting, card edge gripping members positioned at the ends of the card edge receiving slot in the connector. The members are cammed in to grip the inserted card concurrently with the closing of the connector.

2 Claims, 6 Drawing Figures

LATCH DEVICE FOR ZIF CARD EDGE CONNECTORS

BACKGROUND OF THE INVENTION

1. Field of the Invention

The invention disclosed herein relates to card latching systems on card-edge connectors of the type having a vertically moving upper housing to cam contact elements into and out of engagement with the card. Such latching systems retain the card in the connector slot against vibrational-induced movement, against unintentional withdrawal, and against the frictional force of the contact elements as they wipe against the card.

2. Prior Art

The present invention is a novel improvement and a departure from at least the following: U.S. Pat. No. 4,107,138, by Evans.

Evans discloses a card edge connector having a vertically moving member mounted in the slot of the base with openings in the member through which contact elements extend. The inserting card forces the member down so that cam surfaces defining the openings cam the contact elements against the card. Concurrently, latch arms on the base and moving member cooperate to force latch surfaces at the upper ends of elongated arms over an end of the card to retain it in the connector. Further, the movement cocks a second set of arms which, when actuated, withdraws the latch surfaces from the card ends to permit the card withdrawal.

In addition to Evans, prior art patents having latching devices unrelated to contact element camming mechanisms include: U.S. Pat. Nos. 2,825,037, by French; 3,216,580, by Fricker, Jr.; 3,932,016, by Ammenheuser.

French locks a card to a circuit board by means of spring clips which are secured to the board at one end and have a free end extending upwardly and inwardly over a slot in the board. As the card is inserted into the slot, the free ends snap into perforations in the opposing sides of the card to hold it in place.

Fricker, Jr. incorporates resilient members attached to card guides positioned at each end of a card edge connector. A nose-like projection is attached to the upper members so that an inserting card, riding on the slanting surface, cams the upper member away and as the card is driven home, the projection enters a notch on the side of the card to retain it in the connector. The projection is withdrawn by moving the upper members outwardly.

Ammenheuser discloses a similar device as did Fricker, Jr. A resilient catch is an integral part of card guides positioned at each end of a card edge connector. The nose-like projection on the catch performs in substantially the same way as the Fricker, Jr. device.

SUMMARY OF THE INVENTION

The present invention is a latch device which locks cards into card edge connectors concurrently with the closing of the connector. The latch devices are located at each end of the card receiving slot and have V-notches which, when pivoted in towards the card receiving slot, grip the sides of the card to prevent inadvertent withdrawal as well as card movement caused by vibrations and the like. The pivoting latch devices are cammed into the slot by an angled camming slot pinned to the vertically moving member of the connector which closes the contact elements therein against the conductive traces on the card.

DESCRIPTION OF THE INVENTION

Figure 1:
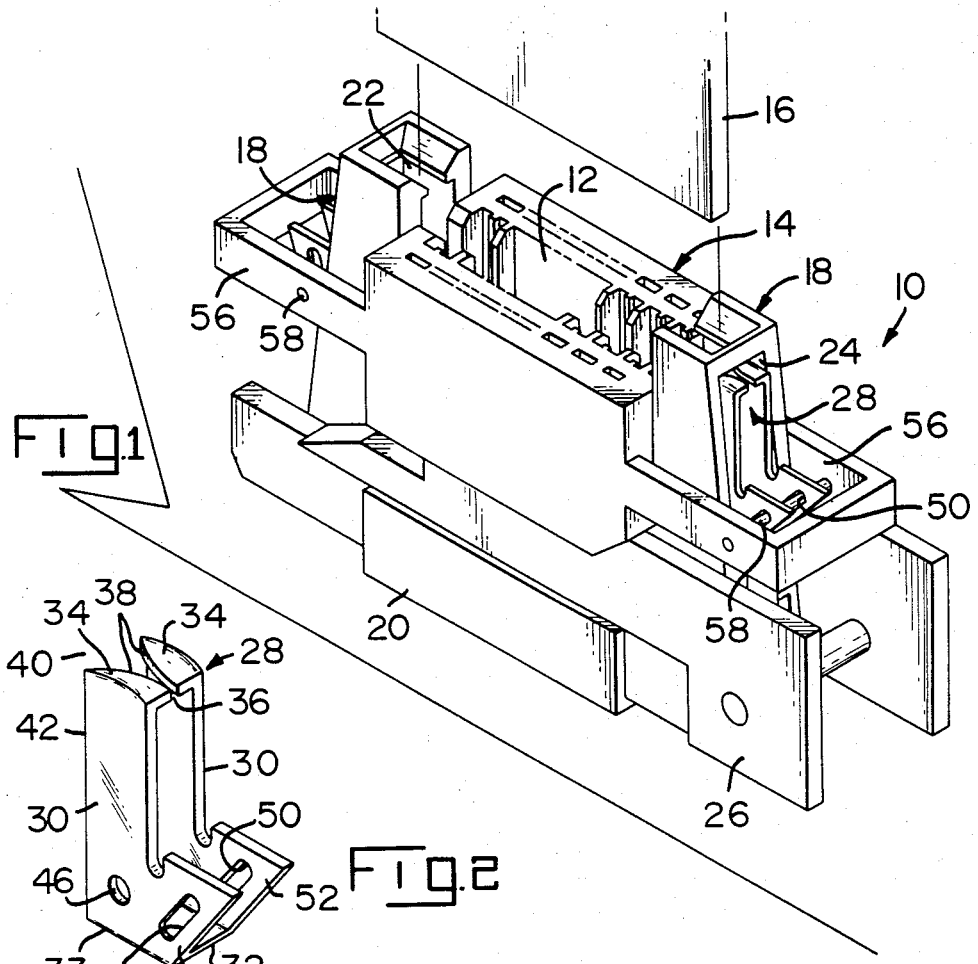
FIG. 1 is an isometric view of a zero insertion force, card edge connector into which the latch devices of the present invention are incorporated.

With specific reference to FIG. 1, connector 10 illustrated therein is a zero insertion force type connector such as manufactured and sold by AMP Incorporated of Harrisburg, Pa., under the name High Density ZIF Card Edge Connector. The connector includes card receiving slot 12 and upper housing 14 which moves vertically upwardly to cam contact elements (not shown) in towards the slot to abut conductive traces or circuits (not shown) on circuit card 16.

The connector further includes non-moving card guides 18 which are attached to and extend vertically upwardly from lower housing 20. These guides have slots 22 and openings 24 therethru, both of which are in alignment with slot 12.

Upper housing 14 is moved up and down by camming mechanism located in and between the two housing. The mechanism includes lever 26 which is moved back and forth to obtain the vertical movement.

Figure 2:
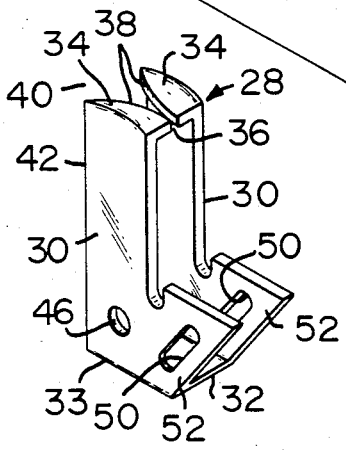
FIG. 2 is an isometric view of the latch device of the present invention standing alone for clarity.

The latch device of the present invention, indicated by reference numeral 28, is shown isometrically in FIG. 2 to which attention is now directed. The device includes two L-shaped sides 30 with each side being the mirror image of the other. They are joined together by strap 32 located at the lower ends 33. The upper end of the elongated section of each side is defined by a turned-in flange 34 so that the edges 36 face each other. The flanges are bowed with the convex surface facing upwardly. A section of the edge of each flange is beveled as indicated by reference numeral 38. The two beveled sections cooperate to define there between a V-groove 40.

Holes 46 are provided near the lower end 33 of each side. These holes receive a pin about which the device pivots.

Diagonally extending cam slots 50 are provided in each short perpendicular camming section 52 of the L-shaped sides.

Figure 3:
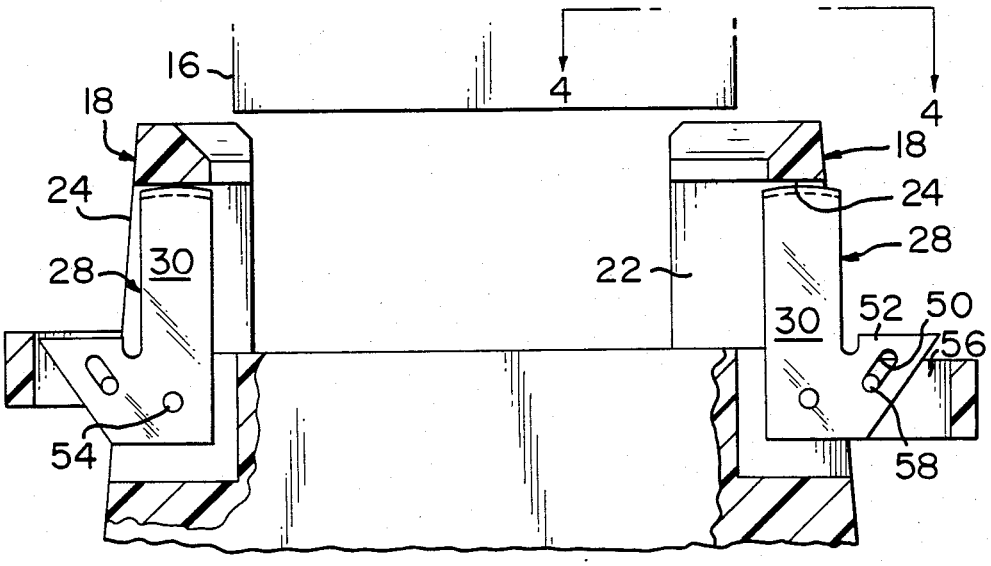
FIG. 3 is a diagrammatical, side view of the connector of FIG. 1, sectioned to illustrate the latch devices incorporated therein, prior to the insertion of a circuit card.

As shown in the several Figures; e.g., FIGS. 1 and 3, the latch devices are pivotally mounted on pins 54 (FIG. 3) which pass thru holes 46 and are anchored in the side walls of the card guides. Sides 30 of the latch devices are substantially within the side walls defining slot 22 and the mouth of the V-groove face into slot 12. Camming sections 52 extend outwardly from the guides and are positioned between side rails 56 which are extensions of and move with upper housing 14. Pins 58, anchored in side rails 56, pass thru diagonal slots 50.

Figure 4:
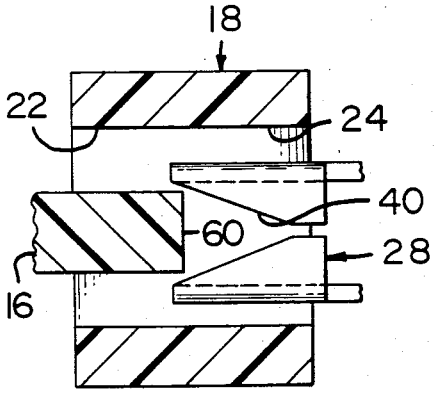
FIG. 4 is a view taken along line 4—4 in FIG. 3 looking down at one latch device.

FIG. 3 is a diagrammatical view with the card guides 18 sectioned to show latch devices 28 (and connector) in the open condition. Note that the devices are generally within openings 24. Card 16, shown above, can be freely inserted into slots 12 and 22. FIG. 4 shows the relation between side 60 on card 16 and V-groove 40 on latch device 28.

Figure 6:
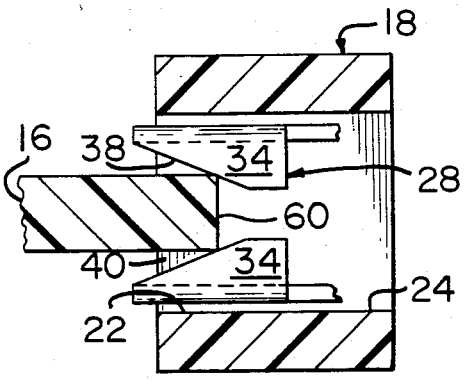
FIG. 6 is a view taken along line 6—6 in FIG. 5 looking down at one latch device locked onto a side of the card.
Figure 5:
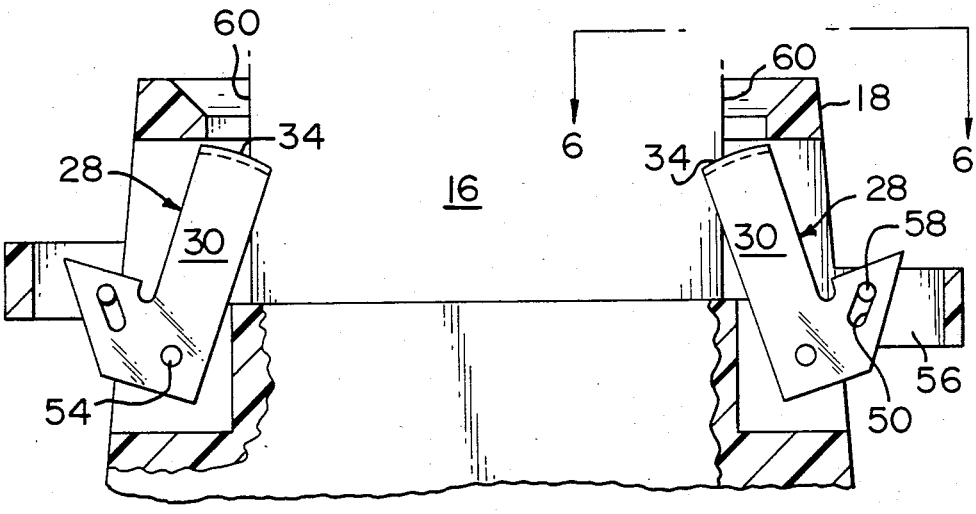
FIG. 5 is the side view of FIG. 3 subsequent to the card being inserted into and the connector closed.

FIG. 5 is a diagrammatical view with card guides 18 sectional to show the latch devices (and connector) in the closed condition. Card 16 has been inserted into slots 12 and 22 and upper housing 14 moved upwardly to cam the contact elements (not shown) in against the card traces. As side rails 56 moved up with the upper housing, pins 58 moving therewith, traveled up diagonal slots 50 and thereby pivoted latch devices so that upper ends 34 moved into slots 22 and towards slot 12. In doing so, the sides 38 of V-grooves 40 grip sides 60 of card 16. FIG. 6 illustrates the latching of the card into connector 10. The upper ends spread apart to grip the card. This spreading is indicated in FIG. 6.

Card 16 may be released by moving upper housing 14 down.

One salient feature of latch devices 28 is that a card cannot be inserted into a empty and closed connector. The card will be stopped by flanges 34 protruding into slots 22. This will prevent damage to the contact elements which would be projecting into slot 12.

The present invention may be subject to many modifications and changes without departing from the spirit or essential characteristics thereof. The present embodiment is therefore intended in all respects as being illustrative and not restrictive of the scope of the invention.

We claim:

1. A latch device located at each end of a card receiving slot in a card edge connector of the type having a vertically moving upper housing, said device comprising a pair of spaced apart L-shaped sides connected at the lower ends and having turned in flanges at the upper ends of the elongated sections with the edges thereof defining a V-groove to receive there between the side of the card, and diagonal slots located in the short perpendicular sections of the sides, said device being pivotally mounted by a pin extending thru holes in the elongated sections and anchored in a non-movable part of the connector and with a pin passing thru the diagonal slots and anchored to the movable upper housing so that as the upper housing moves upwardly, the upper ends of the device move in towards the card receiving slot so that the side of a card which may be in the slot is gripped by the edges defining the V-groove.

2. The latch device of claim 1 wherein the upper ends of the elongated sections may be resiliently spread apart.

* * * * *